United States Patent [19]

Horii et al.

[11] Patent Number: 4,899,442

[45] Date of Patent: Feb. 13, 1990

[54] HAND-HELD CLIPPER FOR REMOVING ENTANGLED FIBER STRANDS FROM THE SURFACE OF FABRICS

[75] Inventors: Sadashige Horii; Hideaki Haraguchi, both of Hikone; Ayako Chatani, Ashiya, all of Japan

[73] Assignee: Matsushita Electric Works, Ltd., Japan

[21] Appl. No.: 232,228

[22] Filed: Aug. 15, 1988

[30] Foreign Application Priority Data

Sep. 4, 1987 [JP] Japan ..... 62-222478

[51] Int. Cl.[4] ..... B26B 19/14

[52] U.S. Cl. ..... 30/133; 30/34.2; 30/41; 30/43.6

[58] Field of Search ..... 30/133, 41, 41.5, 41.6, 30/43.4, 43.5, 34.2, 43.6; 15/347

[56] References Cited

U.S. PATENT DOCUMENTS

| | | | |
|---|---|---|---|
| 3,611,566 | 10/1971 | Brennan, Sr. | 30/41.5 |
| 4,089,110 | 5/1978 | Rasco | 30/41.5 |
| 4,150,483 | 4/1979 | Kanazawa | 30/133 |
| 4,675,998 | 6/1987 | Thijsse | 30/34.2 |
| 4,788,769 | 12/1988 | Maruyama | 30/133 |

FOREIGN PATENT DOCUMENTS

| | | | |
|---|---|---|---|
| 731123 | 6/1955 | United Kingdom | 30/34.2 |
| 1073070 | 6/1967 | United Kingdom . | |

*Primary Examiner*—Douglas D. Watts
*Assistant Examiner*—Y. Lin
*Attorney, Agent, or Firm*—Stevens, Davis, Miller & Mosher

[57] ABSTRACT

A clipper comprises an elongated handle grip 10 and a cutting head 20 which has an outer shearing foil 22 and an inner cutter assembly 40 driven to rotate in engagement with the undersurface of the outer shearing foil 22 for clipping the entangled fiber strands from the surface of a fabric. The cutting head 20 has a center axis which is perpendicular to the general top plane of the shearing foil 22 and about which the inner cutter assembly 40 rotates. The cutting head 20 extends forwardly from the one longitudinal end of the handle grip 10 with its center axis angled at an obtuse angle with respect to the longitudinal axis of the handle grip 10. A recovery chute 60 is provided along the front face 11 of the handle grip 10 for recovering the clipped fiber strands from within the cutting head 20. The chute 60 has a tapered front surface 61 which tapers from its one end adjacent the cutting head 20 towards the opposite end such that the front surface 61 of the chute 60 is increasingly spaced from the general top plane of the cutting head 20 towards its end remote from the cutting head 20 along the length of the handle grip 10.

9 Claims, 7 Drawing Sheets

HAND-HELD CLIPPER FOR REMOVING ENTANGLED FIBER STRANDS FROM THE SURFACE OF FABRICS

BACKGROUND OF THE INVENTION

1. Field of the Invention

The present invention is directed to a hand-held clipper for removing entangled fiber strands from the surface of fabrics, and more particularly to such a clipper having a cutting head which is manipulated across the surface of the fabrics with the handle grip thereof held in one hand of the user.

2. Description of the Prior Art

Such hand-held clippers have been proposed for cropping the entangled fiber strands or wads thereof undesirably occurring on clothing such as sweaters, socks, tights or the like fabrics. As disclosed in Japanese Utility Model Publications No. 55-135097 of 1980 and No. 58-117797 of 1983, the prior clipper includes a cutting head having an outer shearing foil and an inner cutter assembly driven to rotate for shearing the wads of entangled fiber strands entering perforations in the shearing foil. In the prior clippers, the cutting head is mounted at one end of a handle grip to be held by one hand of the user and is enlarged to form therein a head chamber for recovering the clipped fiber strands. Nevertheless, the head chamber is still limited in space and is therefore required to be emptied out frequently. This is inconvenience, and to make the matter worse, the clipped fiber strands stored in an excess amount within the head chamber will entrap the inner cutter assembly to thereby hamper the rotary motion thereof and eventually interrupt the cropping operation. Thus, the prior clipper is unsatisfactory for a continued cropping operation.

To solve this problem, it is first contemplated to provide an additional chute along the length of the handle grip for storing a greater amount of the clipped fiber strands. However, simple addition of the chute to the handle grip would certainly add an extra thickness thereto and therefore narrow the clearance between the cutting surface of the cutting head and the corresponding face of the handle grip or the chute. As the clearance is limited, the fingers of the user's hand grasping the handle grip will interfere with the surface of the fabric across which the cutting head is moved during the cropping operation, thus lowering the handling performance of the clipper. Further, it would be also likely that the added chute obstructs the view of the cutting surface of the cutting head during the cropping operation which should be avoided for giving improved operability to the clipper.

SUMMARY OF THE INVENTION

In view of the above insufficiency and requirement, the present invention is contemplated to provide a hand-held clipper with improved operability. The clipper in accordance with the present invention comprises an elongated handle grip having a longitudinal axis and a cutting head mounted at one longitudinal end of the handle grip. The cutting head comprises an outer shearing foil with a plurality of perforations and an inner cutter means driven to rotate in shearing engagement with the undersurface of the shearing foil for shearing or clipping the wads of the entangled fiber strands on the surface of a fabric. The cutting head has a center axis which is perpendicular to the general top plane of the outer shearing foil defining a cutting surface. Incorporated in the cutting head is a fan which is driven to rotate together with the inner cutter means so as to produce an air flow drawing the air through the perforations and directed outwardly of the cutting head through a discharge port formed in the wall of the cutting head as carrying the clipped fiber strands thereon. The clipped fiber strands are recovered in a chute provided along the handle grip. The cutting head extends forwardly from the one longitudinal end of the handle grip with its center axis inclined at an obtuse angle to the longitudinal axis of the handle grip. The chute extends substantially the full length of the handle grip from its end adjacent to the cutting head to the opposite end thereof so as to have an extended space therein for storing an increase amount of the clipped fiber strands. The front face of the chute is tapered along the longitudinal axis from its end adjacent to the cutting head towards its bottom the opposite end such that thus tapered front face is spaced from the plane of the cutting surface of the cutting head by a greater distance toward the bottom of the chute than at the end adjacent to the cutting head. Whereby it is possible to provide an enlarged clearance between the plane of the cutting surface and the chute so as to well receive therein the fingers of the hand grasping the handle grip without causing the fingers to be interfered with the surface of the fabric across which the cutting head is manipulated.

Accordingly, it is a primary object of the present invention to provide a hand-held clipper for removing the wads of fiber strands from the surface of a fabric which is capable of storing an increased amount of clipped fiber strands while retaining the total assembly as compact as possible, yet assuring a convenience of manipulating the clipper across the surface of the fabric without causing interference therewith.

In a preferred embodiment, the recovery chute is detachably secured to the handle housing, making it easy to empty out the clipped fiber strands. The chute is formed at its bottom opposite to the cutting head with a generally flat face which is cooperative with the adjacent bottom face of the handle grip to form a generally flat base. The clipper can be held in an upright position with this flat base face placed on a supporting surface. The flat base is angled at an acute angle to the plane of the cutting surface so that the cutting head is oriented upwardly and forwardly from the handle grip placed on the support surface, making it easy to position the center of mass of the clipper centrally above the flat base thus contributing to the stable placement of the clipper on the support surface, which is therefore another object of the present invention.

The cutting head defines therein a head chamber within which the inner cutter means and the fan are received with the fan located axially rearwardly of the inner cutter member in spaced relation forwardly of the rear end of the head chamber. The discharge port for intercommunication between the head chamber and the chute is formed at one peripheral portion of the cutting head and radially outwardly of the axial flow generating fan. The fan is disposed within the head chamber in such a manner that the front edge of the fan is in an overlying relation with the front edge of the discharge port along the axial direction of the cutting head and that the rear edge of the fan is in a spaced relation forwardly of the rear edge of the discharge port. With this arrangement, the clipped fibers drawn into the head chamber can be smoothly fed into the chute through the discharge port and can be well prevented from flowing back into the head chamber forwardly of the fan from the chute, which is therefore a further object of the present invention.

The discharge port includes an oblique surface which flares from the rear edge thereof toward the interior of the chute for feeding clipped fibers into the chute in an improved manner, which is therefore a still further object of the present invention.

The handle grip comprises a handle body having a flat front surface on which the chute is slidable along its length for attachment and detachment therefrom. Included in the chute is a filter grid which is fitted over the exhaust port and carries a filter which allows the air to pass therethrough but traps the clipper fibers within the chute. The filter grid is made of a resilient material and formed with a resilient hook for lockable engagement with a stop projection on the front surface of the handle body by the resiliency of the hook. The exhaust port is formed in the rear face of the chute and confronts against the front surface of the handle body to define therebetween a constricted air passage where the air flow is damped and is directed outwardly as a weak flow through a air vent formed between the rear edge of the chute and the front surface of the handle body. Thus, the air flow can be discharged outwardly as a weak flow and can be well prevented from carrying the clipped fiber strands outwardly of the chute in cooperation with the filtering action of the filter.

It is therefore a further object of the present invention to provide a hand-held clipper which is capable of retaining the clipped fibers within the chute and preventing them from accidentally being discharged outwardly on the air flow.

These and still other objects and advantages of the present invention will become more apparent from the following description of the preferred embodiment when taken in conjunction with the attached drawings.

DESCRIPTION OF THE PREFERRED EMBODIMENT

Figure 1:
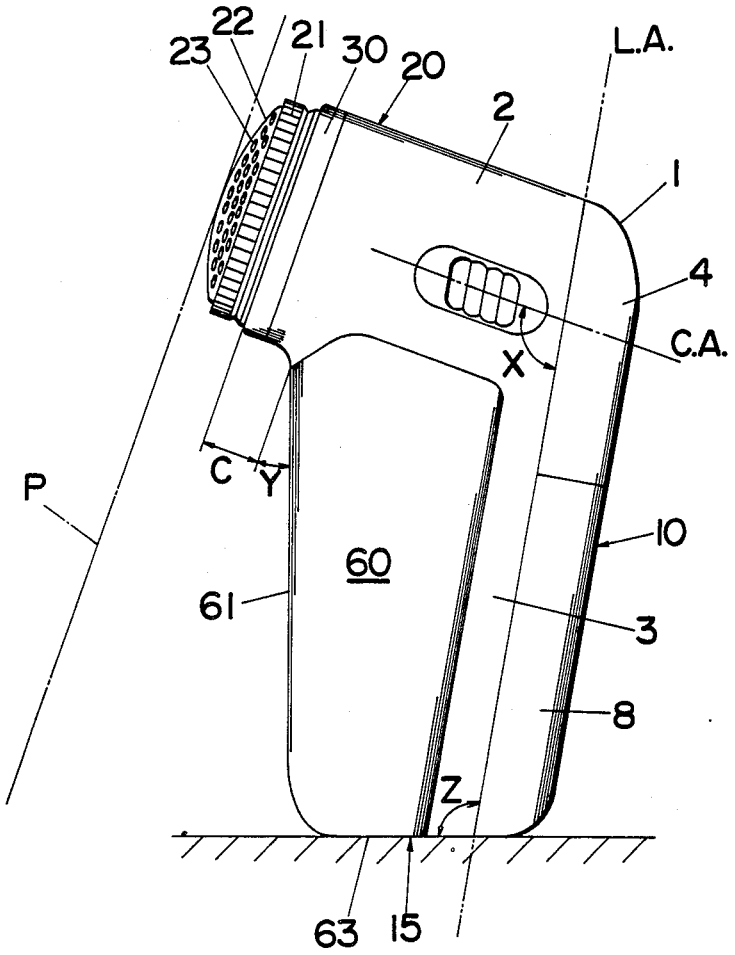
FIG. 1 is a side view of a hand-held clipper in accordance with a embodiment of the present invention.
Figure 7:
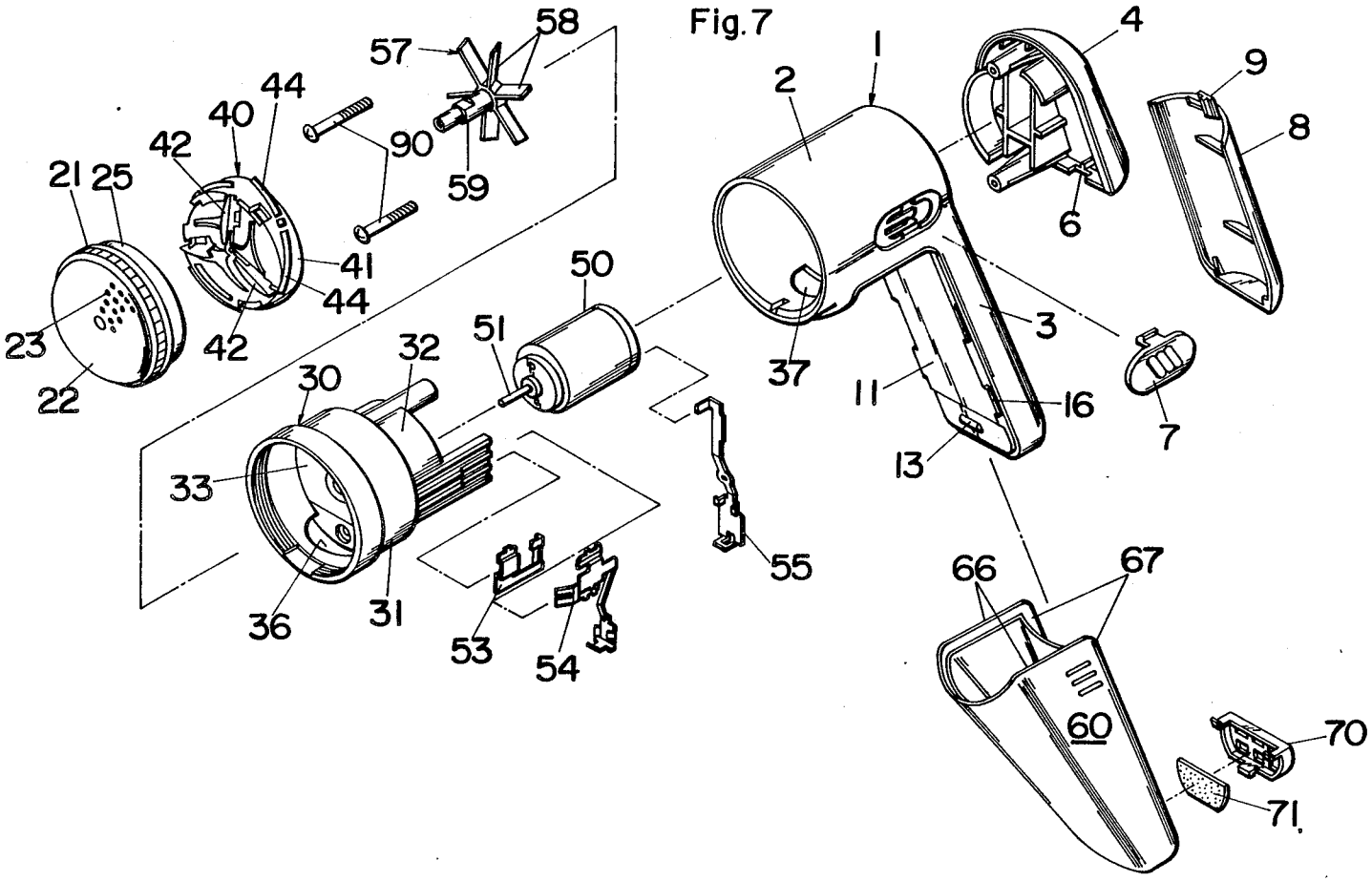
FIG. 7 is a perspective view of the clipper in a disassembled condition.

Referring to FIGS. 1 and 7, there is shown a hand-held clipper for removing the wads of fiber strands from the surface of fabrics in accordance with a preferred embodiment of the present invention. The clipper comprises an elongated handle grip 10 and a cutting head 20 mounted at one end of the handle grip 10. The cutting head 20 includes a generally dome-shaped outer shearing foil 22 with a number perforations 23 and an inner cutter assembly 40 carrying a set of inner blades 42 which are driven by an incorporated electric motor 50 to move in shearing engagement with the undersurface of the outer shearing foil 22 for clipping the wads of the fiber strands appearing on the surface of the fabric. As shown in FIG. 7, the outer shearing foil 22 is supported by a ring frame 21 threaded to a head assembly 30 of a cylindrical configuration which is inserted into a head cylinder 2 integral with a housing 1 made of a plastic material.

Figure 5:
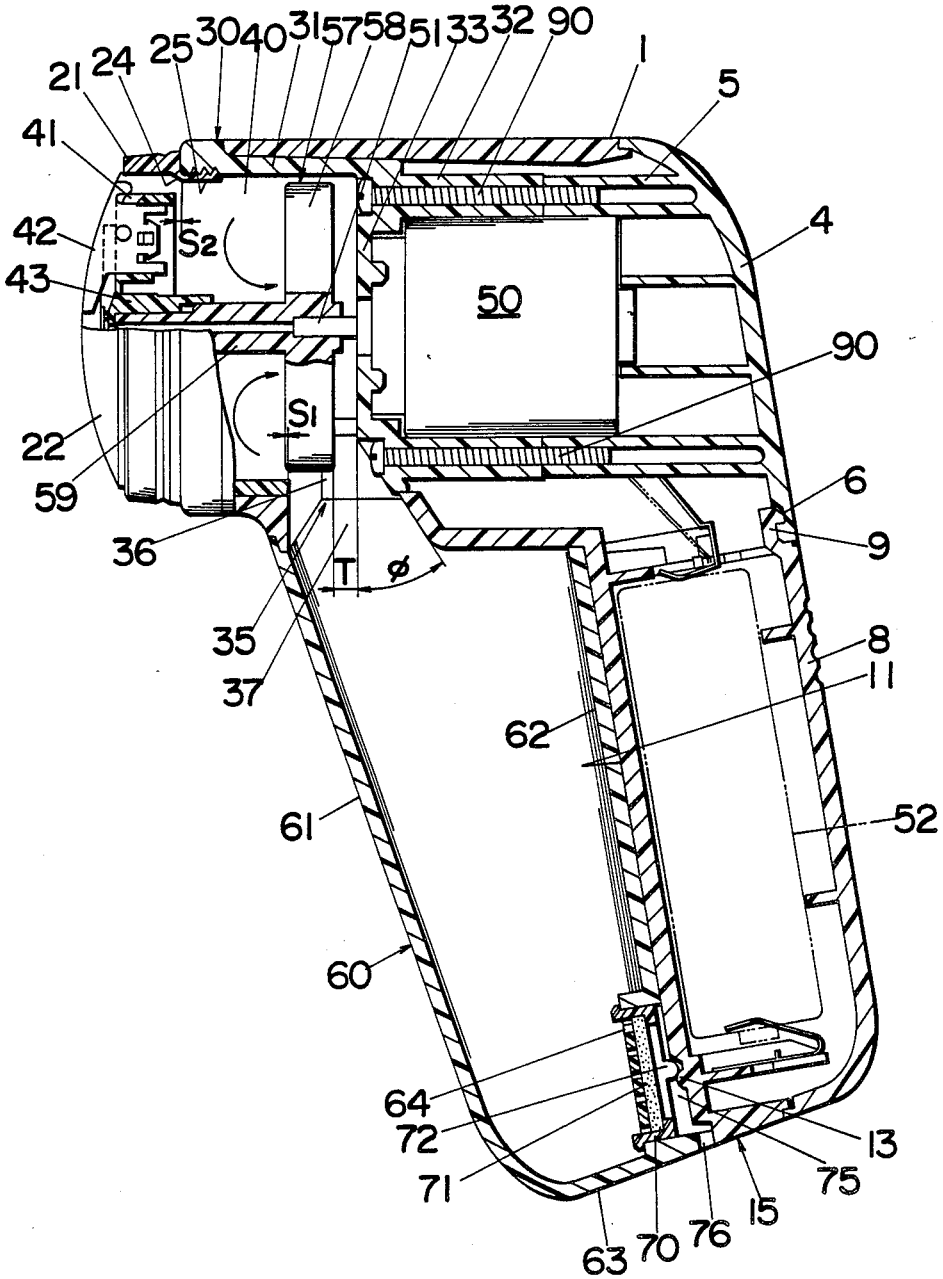
FIG. 5 is a vertical section, partly in side elevation, sectional view of the clipper.
Figure 6:
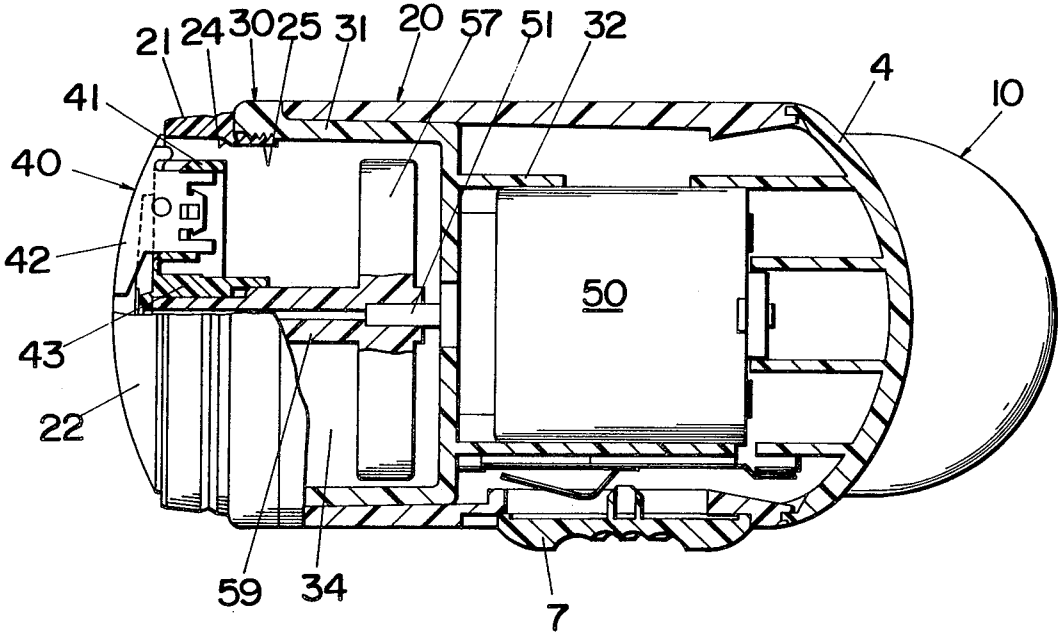
FIG. 6 is a horizontal section, partly in top elevation, of the clipper.

The head assembly 30 comprises a front tube 31 and a rear sleeve 32 which are separated by a bottom plate 33 defining forwardly thereof a head chamber 34 within which the inner cutter assembly 40 is received. The head assembly 30 is secured in the head cylinder 2 by means of screws 90 extending through the bottom plate 33 into threaded bosses 5 on a rear cover 4 fitting over the rear opening of the head cylinder 2. The motor 50 is held in place between the bottom plate 33 and the rear cover 4 with its output shaft 51 extending forwardly of the bottom plate 33 into the head chamber 34, as shown in FIGS. 5 and 6. The motor 50 is energized by dry a battery 52 received in a handle body 3 integrally extending from the rear end of the head cylinder 2. A power switch knob 7 is provided on the head cylinder 2 to connect and disconnect the motor 50 from the battery 52 through several contacts 53 to 55. The handle body 3 is fitted with a detachable battery cover 8 which is continuous with that of the rear cover 4 to form a rear wall of the handle grip 10. The battery cover 8 is detachable to the handle body 3 with its upwardly projecting tab 9 engaged with a notch 6 in the lower end of the rear cover 4.

The inner cutter assembly 40 comprises a rotor disk 41 carrying the inner blades 42 and connected at its center axle 43 to the output shaft 51 of the motor 50 so as to be driven thereby to rotate about an axis of the axle 43. In this sense, the axle 43 defines a center axis of the cutting head 20, which is indicated by C.A. in FIG. 1 and extends in perpendicular relation to a general top plane P of the outer shearing foil 22.

Turning back to FIGS. 5, 6 and 7, the head chamber 34 accommodates a fan 57 which is connected at its center spindle 59 between the output shaft 51 and the center axle 43 to be driven to rotate together with the inner cutter assembly 40. The fan 57 is of an axial flow type comprising a number of radially extending blades 58 which are inclined with respect to the axial direction in order to generate an air flow drawing in the outside air into the head chamber 34 through the perforations 23 of the outer shearing foil 22. Thus, the clipped fiber strands are carried on the air flow and forced to be directed into the head chamber 34 where they are in turn carried radially outwardly through a discharge port 35 in the wall of the cutting head 20 while they are partly compressed against the bottom plate 33 of the head chamber 34 prior to be thrown outwardly through the deliver port 35.

Figure 2:
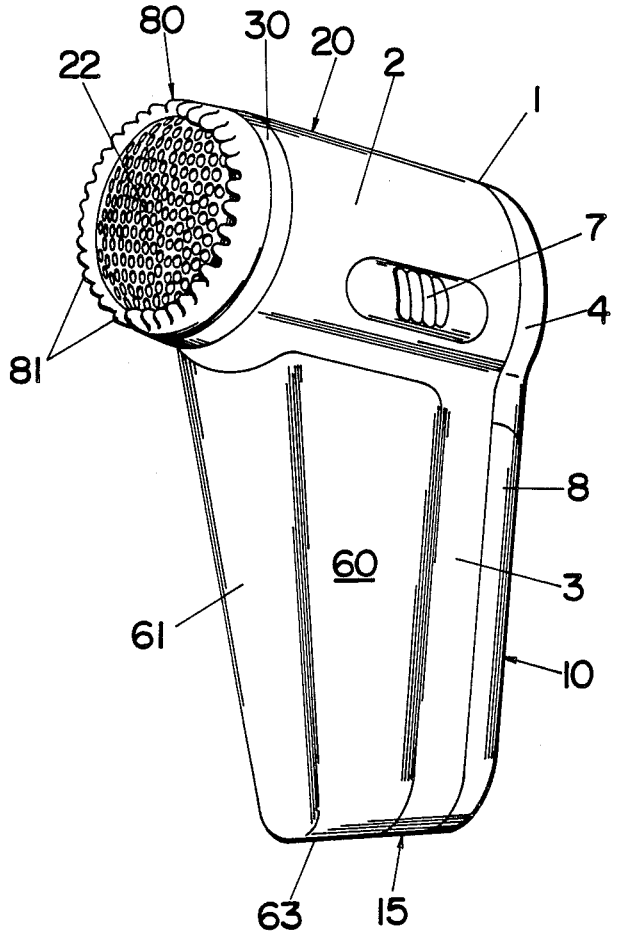
FIG. 2 is a perspective view of the clipper.
Figure 3:
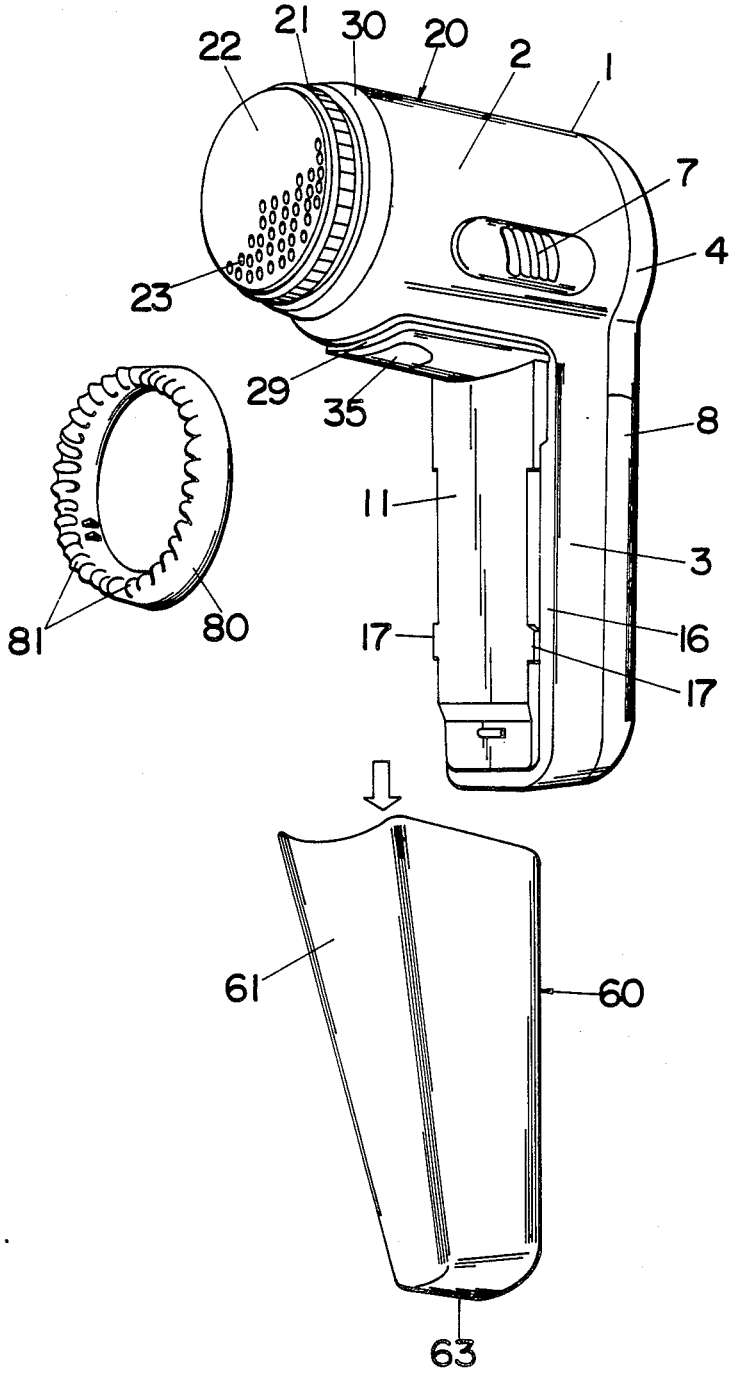
FIG. 3 is an exploded perspective view of the clipper.

The clipped fiber strands are recovered in a chute 60 detachably mounted on the handle body 3 of the housing 1. The chute 60 is cooperative with the handle body 3 and the covers 4 to define the handle grip 10 which is elongated along a longitudinal axis L.A. extending at an obtuse angle X of about 100° with respect to the center axis C.A. It should be noted at this point that the handle body 3 extends along the longitudinal axis L.A. integrally from the head cylinder 2 of the housing 1 and having a generally flat front surface 11 on which the chute 60 is mounted. The chute 60 is also an elongated casing which extends the full length of the handle body 3 and has a top opening 65 in adjacent relation to the cutting head 20 or the discharge port 35 thereof. The front wall 61 of the chute 60 tapers toward its lower end so that it is spaced by a greater distance from the top plane P of the cutting head 20 toward its lower end than that the upper end adjacent the cutting head 20, leaving therebetween enough space for receiving the fingers of the user's hand grasping the handle grip 10 and therefore improving the convenience of manipulating the clipper with the cutting head 20 constantly kept in touch with the surface of the fabric. In this connection, the front wall 61 of the chute 60 merges at its upper edge to the wall of the cutting head 20 at a point spaced rearwardly from the ring frame 21 by a clearance C of about 10 mm. And the front wall surface 61 of the chute 60 tapers from this point with an inclination angle Y of about 20° for an improved convenience of handling the clipper. As shown in FIGS. 2 and 3, a comb ring 80 with a number of peripheral comb teeth 81 may be selectively attached around the support ring for lifting the wads of fiber strands and feeding them into the perforations 23.

The chute 60 is slidable along the longitudinal axis and is attached to the handle body 3 with its rear wall 62 in contact with the front surface 11 of the handle body 3. In the attached position, the bottom wall 63 of the chute 60 is flush with the bottom of the handle body 3 so as to be cooperative therewith to give a flat base 15 for upright placement of the clipper on a supporting surface by this flat base, as shown in FIG. 1. The flat base 15 is inclined at an obtuse angle Z with respect to the longitudinal axis L.A. of the handle grip 10 so that the mass center of the clipper will pass through the center portion of the flat base 15 for stable upright placement of the clipper. The chute 60 is provided in its lower end of the rear wall 63 with an exhaust port 64 with a number of tiny apertures and a filter 71 which allows the air to pass therethrough while entrapping the clipped fiber strands within the chute 60. The filter 71 is supported by a filter grid 70 which is made of a resilient plastic material and is secured to the rear wall 63 of the chute 60. Formed on the grid 70 is a hook 72 for lockable engagement with a corresponding stop projection 13 formed at the lower end portion of the handle body 3 for retaining the chute 60 on the handle body 3 in the position of FIG. 5. As seen in the figure, the grid 70 or the exhaust port 64 is recessed and spaced forwardly of the front surface 11 of the handle body 3 by a short distance so as to define therebetween a constricted air passage 75 which opens to the outside through an air vent 76 defined between the rear edge at the lower end the chute 60 and the corresponding lower edge of the handle body 3. Thus, the air flow created by the fan 57 can escape outwardly from the chute 60 through the exhaust port 64, air passage 75, and the air vent 76, during which the air flow is deflected and baffled for improving the filtering effect at the filter 70 by preventing the clipped fiber strands from being accidentally flown outwardly on the otherwise developing rapid air flow.

Figure 4:
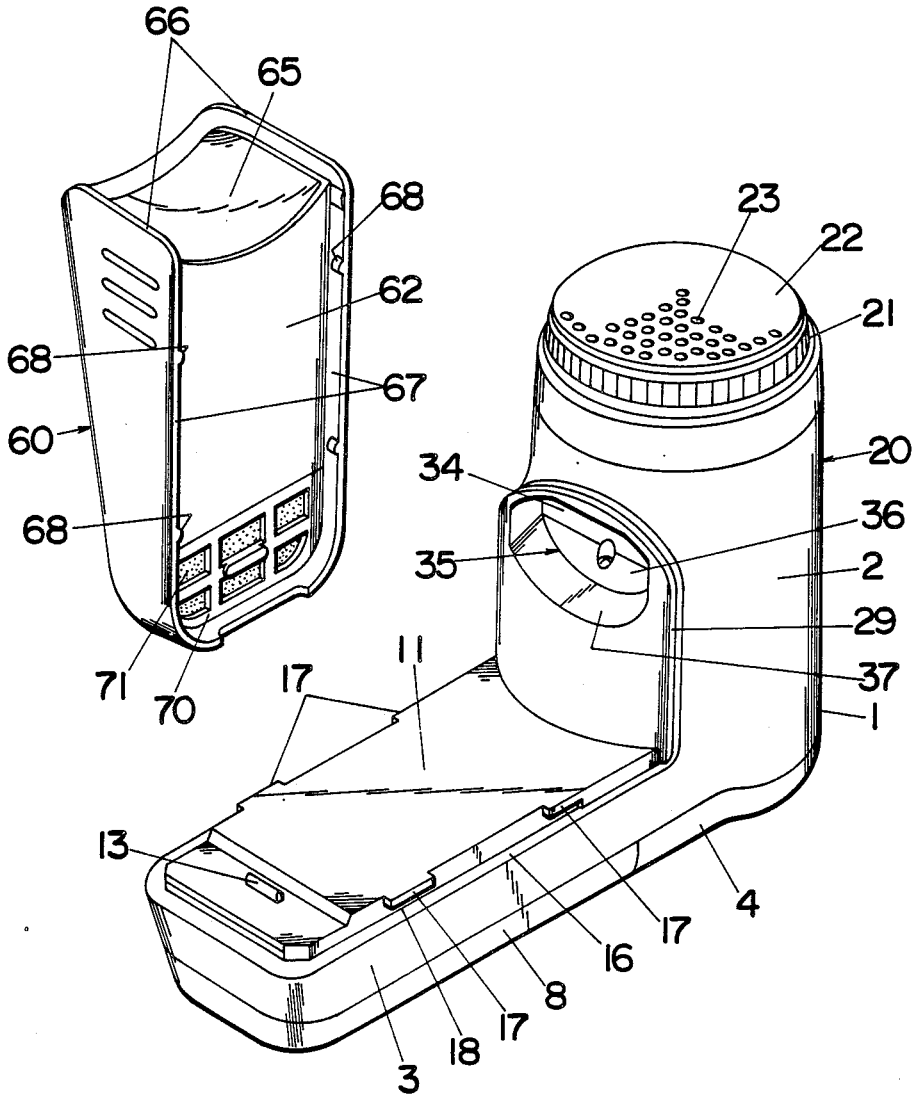
FIG. 4 is an exploded perspective view of the clipper viewed at a different angle.

Projecting rearwardly from the lateral sides of the rear wall of the chute 60 are side flanges 67 which are slidably fitted in stepped portions 16 on the lateral sides of the front surface 11 of the handle body 3. As shown in FIG. 4, each of the stepped portions 16 includes longitudinally spaced guide ribs 17 projecting laterally outwardly from the front surface 11 of the handle body 3 to define a channel 18 therebelow. On the other hand, each of the side flanges 67 has inward projections 68 which are guided between the channels 18 so as to make the chute 60 slidable along the handle body 3.

Extending around the top opening 65 of the chute 60 is a rim 66 which projects upwardly from the front and the opposite sides of the chute 60 so as to be fitted in corresponding grooves 29 formed in the wall of the cutting head 20 around the discharge port 35. On the other hand, the rear edge of the top opening 65 is curved to be fitted on the correspondingly curved surface of the cutting head 20. Thus, the chute 60 is tightly fitted around its top opening 65 to the cutting head 10.

Referring back to FIGS. 5 and 7, the discharge port 35, which is composed of a hole 36 in the head assembly 30 and a corresponding opening 37 in the head cylinder 2. As shown in FIG. 5, the rear edge of the discharge port 35 is inclined downwardly outwardly at an angle $\phi$ of about 40° to the vertical for smoothly feeding the clipped fiber strands into the chute 60 from the head chamber 34. In this connection, the fan 57 has its rear edge spaced forwardly at a distance T from the bottom plate 33 so that the clipped fiber strands can be compressed against the bottom plate 33 by the operation of the fan 57 and are then carried into the chute 60 through the flared discharge port 35. Further, the fan 57 has its forward edge in an overlying relation by a slight extent $S_1$ to the front edge of the discharge port 35 with respect to the axial direction of the cutting head 10 so that the peripheral air flow developed in the peripheral portion of the axial flow fan 57 is substantially blocked by the front edge of the discharge port 35, thus making the fiber strands floating in the upper portion of the chute 60 free from being influenced by such peripheral air flow to thereby prevent the reentry of the fiber strands into head chamber 34 forwardly of the axial flow fan 57.

Also shown in FIG. 5, the ring frame 21 is formed on its inner surface with a taper shoulder 24 tapering rearwardly toward a narrowed portion 25 of which outer surface is threaded to the head assembly 30 in order to smoothly direct the clipped fiber strands towards the bottom of the head chamber 34 as guiding them over the tapered shoulder 24. For facilitating this, the rear edge of the rotor disk 41 is spaced forwardly by a slight distance $S_2$ from the point where the tapered shoulder 24 merges the narrowed portion 25 as to leave between the inner surface of the ring frame 21 and the peripheral edge of the inner cutter assembly 40 an enough space for directing the clipped fiber strands toward the fan 57.

As shown in FIG. 7, the rotor disk 41 is provided on its periphery with circumferentially spaced oblique wings 44 which produces around the rotor disk 41 a local air flow or swirl upon rotation of the inner cutter assembly 30. The local air flow is additive to the air flow generated by the fan 57 so as to direct the clipped fiber strands around the inner cutter assembly 40 towards the fan 57.

What is claimed is:

1. A hand-held clipper for removing entangled fibers from the surface of fabrics comprising:

an elongate handle grip having a longitudinal axis;

a cutting head formed at one longitudinal end of said handle grip, said cutting head comprising a perforated outer shearing foil and an inner cutter means driven to move in shearing engagement with the undersurface of said outer shearing foil for shearing the entangled strands of fibers entering the perforations in said outer shearing foil;

said cutting head having a center axis which is perpendicular to the general top plane of said outer shearing foil;

said cutting head incorporating a fan operating together with said inner cutter means for producing an air flow which draws in outside air through said perforations of the outer shearing foil and flows outwardly through a discharge port of said cutting head carrying clipped fiber strands in said air flow;

said handle grip being provided with a recovery chute for receiving therein said clipped fiber strands carried in the air flow;

said cutting head extending forwardly from said one longitudinal end of said handle grip with the center axis thereof inclined at an obtuse angle to the longitudinal axis of said handle grip;

said chute extending substantially the full length of the front surface of the handle grip from its one longitudinal end adjacent to said cutting head and to the other longitudinal end, said recovery chute having an exhaust port with a filter fitted over said exhaust port for entrapping the clipped fiber strands within said chute and for discharging the air outwardly while the clipped fiber strands are stored therein; and said recovery chute having along its length a tapered front surface which tapers from said one longitudinal end adjacent to the cutting head to the other end of the handle grip such that said tapered front surface is spaced from the general top plane of the outer shearing foil by a greater distance toward said other end than at the one end adjacent to said cutting head.

2. A hand-held clipper as set forth in claim 1, wherein said recovery chute is detachable from the handle grip.

3. A hand-held clipper as set forth in claim 1, wherein said recovery chute is formed at said other end opposite to the cutting head with a generally flat bottom face which cooperated with the adjacent bottom face of said handle grip to form a generally flat base angled at an acute angle to the general top plane of said outer shearing foil.

4. A hand-held clipper as set forth in claim 1, wherein said cutting head defines a head chamber within which said inner cutter means and said fan are received with said fan located axially rearwardly of said inner cutter member in a spaced relation forwardly of rear end of said chamber, said discharge port being formed in one peripheral portion of said cutting head for intercommunication between the rear end portion of said head chamber and said recovery chute, and said fan having its front edge in overlying relation with front edge of said discharge port along the axial direction of said cutting head and having its rear edge forwardly of rear edge of said discharge port.

5. A hand-held clipper as set forth in claim 4, wherein said discharge port including an oblique surface which flares from the rear edge thereof toward the interior of said recovery chute.

6. A hand-held clipper for removing entangled fibers from the surface of fabrics comprising:

an elongate handle grip having a longitudinal axis;

a cutting head formed at one longitudinal end of said handle grip, said cutting head comprising a perforated outer shearing foil and an inner cutter means driven to move in shearing engagement with the undersurface of said outer shearing foil for shearing the entangled strands of fibers entering the perforations in said outer shearing foil;

said cutting head having a center axis which is perpendicular to general top plane of said outer shearing foil;

said cutting head incorporating a fan operating together with said inner cutter means for producing an air flow which draws in outside air through said perforations of the outer shearing foil and flows outwardly through a discharge port of said cutting head carrying clipped fiber strands in said air flow;

said handle grip being provided with a detachably mounted recovery chute for receiving therein said clipped fiber strands carried in the air flow;

said cutting head extending forwardly from said one longitudinal end of said handle grip with the center axis thereof inclined at an obtuse angle to the longitudinal axis of said handle grip;

said chute extending substantially the full length of the front surface of the handle grip from its one longitudinal end adjacent to said cutting head and to the other longitudinal end, said recovery chute having an exhaust port for discharging the air outwardly while storing the clipped fiber strands therein; and said recovery chute having along its length a tapered front surface which tapers from said one longitudinal end adjacent to the cutting head to the other end of the handle grip such that said tapered front surface is spaced from the general top plane of the outer shearing foil by a greater distance toward said other end than at the one end adjacent to said cutting head wherein said handle grip includes a handle body extending along said longitudinal axis and having a generally flat front surface on which said recovery chute is slidable along said longitudinal axis for attachment and detachment therefrom, said recovery chute including a filter grid which is fitted over said exhaust port of the recovery chute and carries a filter for entrapping the clipped fiber strands within said chute while allowing the air to pass therethrough, said exhaust port located in the rear wall of said recover chute facing the front surface of said handle body to form therebetween an air passage leading outwardly of said handle grip through an air vent formed between the rear edge of said recover chute and the front surface of said handle body, and said filter grid being made of a resilient material and formed with a resilient hook which is resiliently engaged with a stop projection on the front surface of said handle body for retaining the recovery chute in an attached position to said handle body.

7. A hand-held clipper as set forth in claim 1, wherein said cutting head defines a head chamber within which said inner cutter means is received together with said fan, said outer shearing foil being supported on a ring frame which is attached to said cutting head with its rear portion extended into a front opening of said head chamber, said inner cutter means comprising a rotor disk carrying thereon a number of inner blades urged into shearing contact with the undersurface of said outer shearing foil, said ring frame being formed on its inner wall surface between ends thereof with an tapered shoulder which tapers rearwardly towards the inner wall surface of said rear portion having a smaller diameter than the front portion of said ring frame forwardly of said tapered shoulder, and said rotor disk extending into the front portion of said ring frame with its rear end spaced forwardly of the point at which said tapered shoulder merges the inner wall of said rear portion of narrowed diameter.

8. A hand-held clipper as set forth in claim 7, wherein said rotor disk is provided on its periphery with a set of wings so as to produce between the rotor disk and the inner periphery of the ring frame a circumferential air flow which is additive to said air flow by said fan for drawing in the air through the perforations of the outer shearing foil and directing the same past the periphery of said rotor disk into said head chamber.

9. A hand-held clipper for removing entangled fibers from surface of fabrics comprising:

an elongate handle grip having a longitudinal axis;

a cutting head formed at one longitudinal end of said handle grip, said cutting head comprising a perforated outer shearing foil and an inner cutter means driven to move in shearing engagement with the undersurface of said outer shearing foil for shearing the entangled strands of fibers entering the perforations in said outer shearing foil;

said cutting head having a center axis which is perpendicular to the general top plane of said outer shearing foil;

said cutting head incorporating a fan operating together with said inner cutter means for producing an air flow which draws in outside air through said perforations of the outer shearing foil and flows outwardly through a discharge port of said cutting head carrying clipped fiber strands in said air flow;

said handle grip being provided with a detachably mounted recovery chute for receiving therein said clipped fiber strands carried in the air flow;

said cutting head extending forwardly from said one longitudinal end of said handle grip with the center axis thereof inclined at an obtuse angle to the longitudinal axis of said handle grip;

said chute extending substantially the full length of the front surface of the handle grip from its one longitudinal end adjacent to said cutting head and to the other longitudinal end, said recovery chute having an exhaust port for discharging the air outwardly while storing the clipped fiber strands therein; and said recovery chute having along its length a tapered front surface which tapers from said one longitudinal end adjacent to the cutting head to the other end of the handle grip such that said tapered front surface is spaced from the general top plane of the outer shearing foil by a greater distance toward said other end than at the one end adjacent to said cutting head said handle grip including a handle body extending along said longitudinal axis and having said generally flat front surface on which said recovery chute is slidable along said longitudinal axis for attachment and detachment therefrom, said recovery chute including a filter grid which is fitted over said exhaust port of the recovery chute and carries a filter for entrapping the clipped fiber strands within said chute while allowing the air to pass therethrough, said exhaust port located in the rear wall of said recover chute facing the front surface of said handle body to form therebetween an air passage leading outwardly of said handle grip through an air vent formed between the rear edge of said recover chute and the front surface of said handle body.

* * * * *